United States Patent [19]

Underwood

[11] 4,358,024

[45] Nov. 9, 1982

[54] CONTAINER CLOSURE

[76] Inventor: J. Larry Underwood, c/o Underwood Mold Co., Inc., 104 Dixie Dr., Woodstock, Ga. 30188

[21] Appl. No.: 281,970

[22] Filed: Jul. 10, 1981

[51] Int. Cl.[3] ..... B65D 53/00

[52] U.S. Cl. ..... 220/234

[58] Field of Search ..... 220/233–234, 220/238; 215/358; 138/89

[56] References Cited

U.S. PATENT DOCUMENTS 3,756,480 9/1973 Swett et al. ..... 220/234 X 4,002,516 1/1977 Gaborieau et al. ..... 220/234 X

*Primary Examiner*—George T. Hall

*Attorney, Agent, or Firm*—Jenkins, Coffey, Hyland, Badger & Conard

[57] ABSTRACT

A closure for a container having a radial groove on an inside surface of the mouth of the container includes a lid portion having a central disk with an upstanding wall at the periphery of the disk for contacting the inside surface of the mouth of the container. A plurality of radial projections are provided on an outside surface of the upstanding wall. A region of the upstanding wall surrounding each radial projection is substantially thinner than the remaining portions of the upstanding wall so as to impart radial flexibility between the plurality of projections in the remaining portions of the upstanding wall. Actuating means such as a ring axially displaceable with respect to the upstanding wall is provided radially inside the upstanding wall for radially displacing the plurality of projections for engagement with the radial groove on the inside surface of the mouth of the container.

10 Claims, 7 Drawing Figures

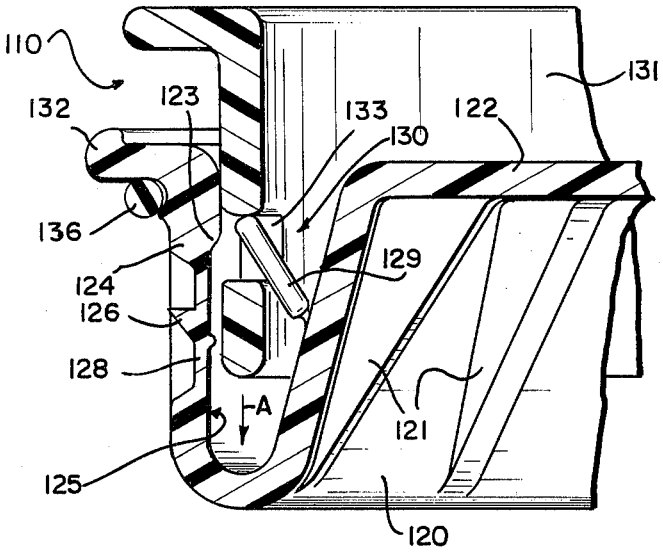
FIG. 4
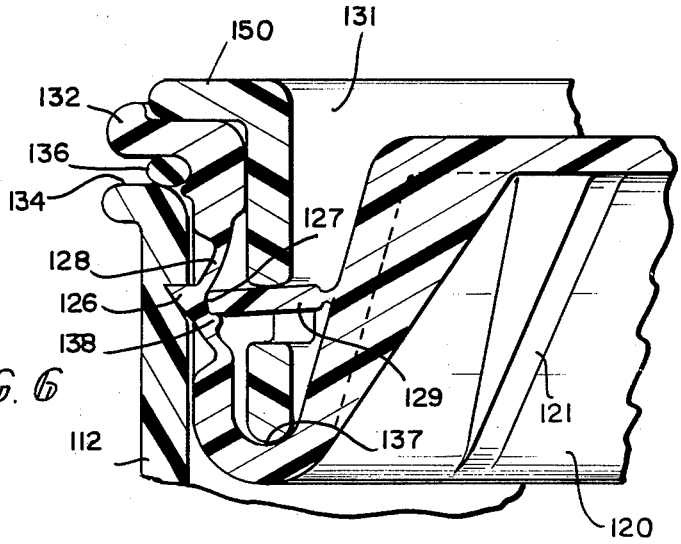
FIG. 6
FIG. 5
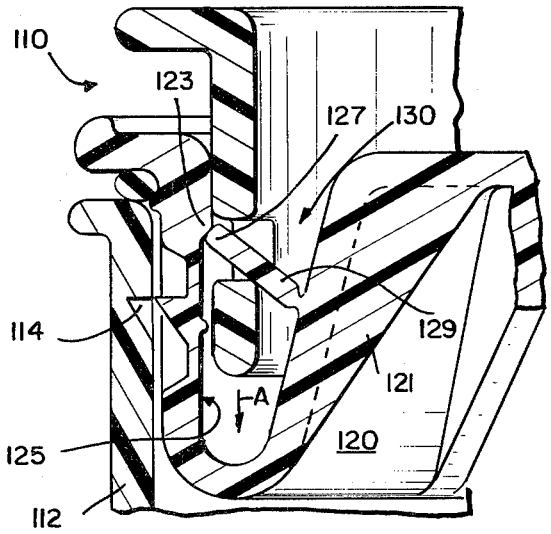
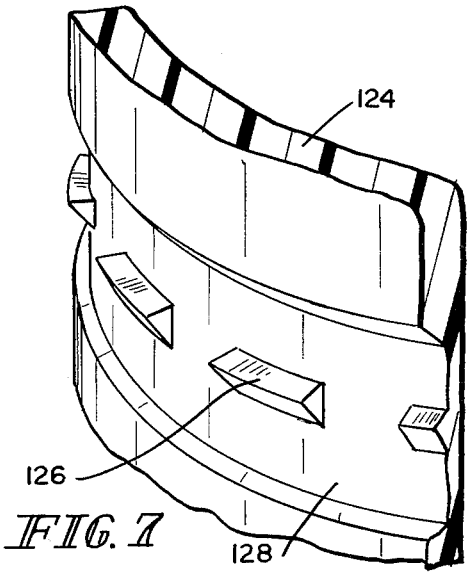
FIG. 7

CONTAINER CLOSURE

This invention relates to the container arts, and particularly to a closure suitable for use with a container having a radial groove on an inside surface of the mouth of the container.

Various designs have been proposed for closures for containers which would include means for lockingly engaging the closure with the container. An example of such a means is a screw thread provided on a flange of a closure for engagement with a similar screw thread provided on or near the mouth of a container.

In view of the use of automated filling lines for filling containers, considerable effort has been made to design closures which are capable of being applied to containers with simple automated equipment not requiring human intervention. Additionally, it is generally felt to be desirable to design closures which are resealable and which may include means which would visually indicate whether the container had been opened at any time following its initial closing under prescribed conditions.

The closure of the present invention includes a lid portion having a central disk with an upstanding wall at the periphery of the disk or contacting an interior surface of a container. A plurality of radial projections are provided on an outside surface of the upstanding wall. A region of the upstanding wall surrounding each radial projection is thinned substantially with respect to the remaining portion of the upstanding wall so as to impart radial flexibility between the plurality of projections and the remaining portion of the upstanding wall. An actuating means is provided radially inside the upstanding wall and axially displaceable with respect thereto for radially displacing the plurality of projections for engagement with a portion of the interior suface of a container.

The closure according to the present invention is specifically designed to cooperate with containers having a radial groove on the inside surface of the mouth of the container. The plurality of radial projections are intended to engage the radial groove. A radially outwardly projecting flange can be provided at the top of the upstanding wall, the flange being intended to overlie the uppermost surface of the container wall. A sealing means, such as an O-ring, can be provided to hermetically seal the closure and container combination.

The upstanding wall can include a dimple on the radially inner side opposite each outwardly projecting radial projection, the dimple cooperating with an appropriate actuating means for radially displacing the projections outward in response to an axial displacement of the actuating means. The dimple is preferably circumferentially smaller than the width of the thinned region surrounding each radial projection. The thinned region surrounding each radial projection is preferably joined to adjacent regions so as to form a circumferentially continuous thinned region.

The actuating means is preferably in the form of a ring axially displacable with respect to the lid. In one embodiment, an outer lower portion of the ring directly cooperates with the dimples present on the radially inner surface of the upstanding wall to displace the radial projections outward. In another embodiment, the ring includes apertures through which tabs from a radially inner portion of the lid project, the tabs being situated to contact the radially inner surface of the upstanding wall immediately inside the radial projections, forcing them radially outward in response to an overcenter condition.

The accompanying drawings illustrate the invention and show two preferred embodiments exemplifying the best mode of carrying out the invention as presently perceived. In such drawings:

FIG. 4 is a sectional detail view of a second embodiment of the present invention showing the lid with the actuating ring partially disengaged therefrom;

FIG. 5 is a sectional detail of the embodiment shown in FIG. 4 with the lid disengaged from a container and the actuating ring captured by the lid;

FIG. 6 is a sectional detail view of the embodiment shown in FIG. 4 with the lid engaged with a container; and FIG. 7 is a sectional detail similar to FIG. 3 of the upstanding wall of the lid shown in FIGS. 4–6 showing the thinned region surrounding the radial projections to be circumferentially continuous.

Figure 1:
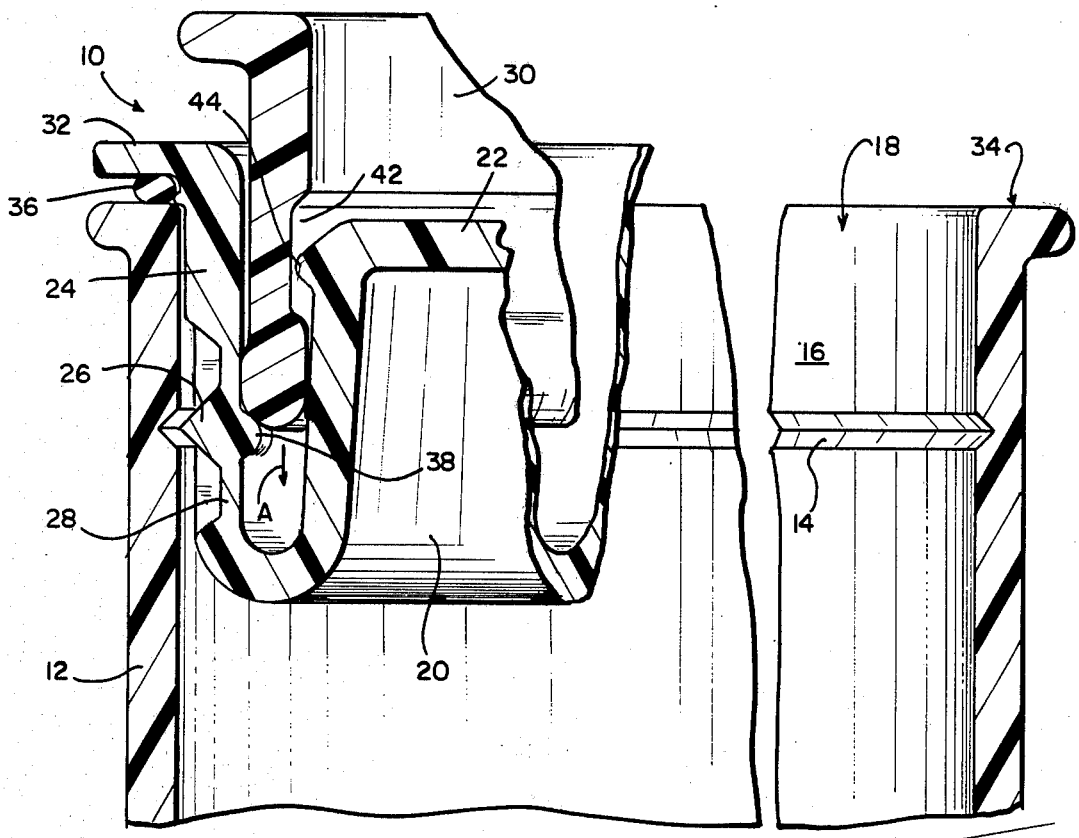
FIG. 1 is a sectional detail of a first embodiment of the invention showing the lid disengaged from a container.
Figure 2:
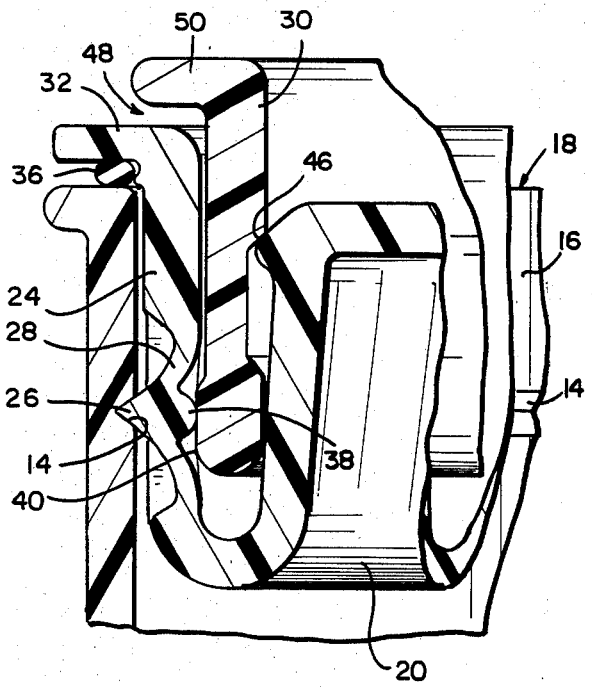
FIG. 2 is a detail of the embodiment of the invention shown in FIG. 1 with the lid engaged with the container.
Figure 3:
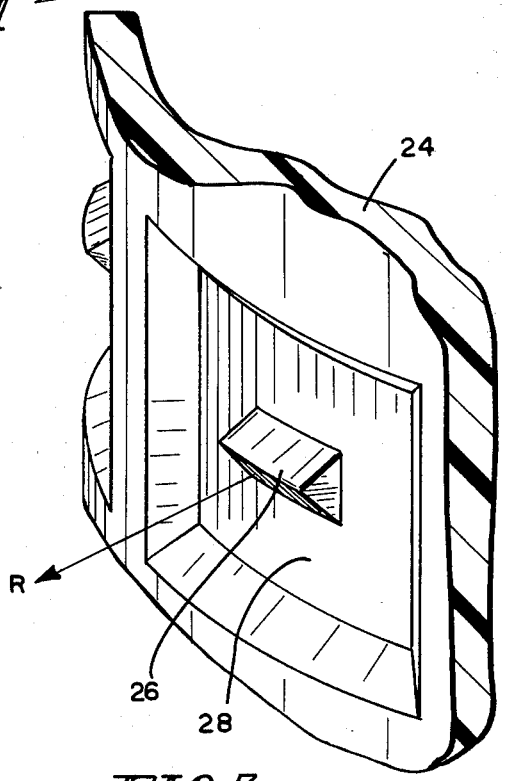
FIG. 3 is a sectional detail of the upstanding wall of the lid showing a radial projection and surrounding thinned region.

FIGS. 1–3 show a first embodiment of the present invention wherein closure 10 is applied to container 12 having a groove 14 on the inside surface 16 of the container near the mouth 18 thereof. The closure 10 includes a lid 20 having a central disk 22 with an upstanding wall 24 at the periphery of the disk 22 for contacting the interior surface 16 of the container 12. A plurality of radial projections 26 are provided on the outside surface of the upstanding wall 24. Each radial projection 26 is surrounded by a region 28 which is substantially thinner than the remaining portion of the upstanding wall 24, thus imparting radial flexibility between the plurality of projections 26 and the remaining portions of the upstanding wall 24. Means, such as ring 30, is disposed radially inside the upstanding wall 24 of lid 20, and is axially displaceable with respect to the upstanding wall 24 in the direction of cap A. When the ring means is displaced in the direction of cap A, the displacement causes a corresponding radial displacement of the plurality of projections 26 outward with respect to the remaining portions of the upstanding wall 24, the plurality of projections 26 engaging the groove 14 on the inside surface 16 of the container 12.

The lid 20 preferably includes flange 32 at the upper end of upstanding wall 24. The flange 32 extends radially outward from the upper end of wall 24 and overlies the lip 34 of the mouth 18 of container 12. A sealing means, such as O-ring 36, can be interposed between flange 32 and lip 34 to hermetically seal the container.

In order that the axial displacement of ring means 30 in the direction A would cause the radial displacement of the plurality of projections 26, a like plurality of dimples 38 are provided on the inside surface of upstanding wall 24, the dimples 38 being circumferentially aligned with the radial projections 26. The dimple 38 physically contacts a lower outside surface 40 of ring 30, the surface 40 being dimensioned such that the axial displacement of ring means 30 forces dimple 38 to move radially outward, thereby causing the corresponding radial projection 26 to be similarly moved. The flexibility imparted by the thinned region 28 surrounding the projection 26 permits the necessary movement. This movement can also be enhanced by an appropriate selection of materials for lid 20 and ring means 30. Appropriate materials for the ring means include high-density polyvinylchloride and the like having very low compressibility.

The ring means 30 can also include a radial depression 42 which interacts with a shoulder 44 on lid 20. The depression 42 and shoulder 44 act together as means for preventing separation of the lid 20 and ring 30 prior to their locking engagement with a container 12. As shown in FIG. 2, an upper surface 46 of depression 42 contacts shoulder 44 to prevent the ring 30 from proceeding axially in the direction A beyond a pre-selected position which leaves a space 48 between an outer extending flange 50 on ring 30 and the uppermost surface of flange 32 on the top of the upstanding wall 24 of lid 20.

While in FIG. 3 the region 28 surrounding radial projection 26 is shown to be rectangular, it will be appreciated by those having skill in the art that the particular shape or outline of the region is not crucial to the invention. Likewise, the particular shape of radial projections 26 is not crucial to the invention, although it is believed that radial projection 26 must be discontinuous, that is, it may not be a continuous ring circumferentially disposed about the perimeter of the outer surface of upstanding wall 24. A continuous ring might of itself have sufficient strength to resist any outward displacement by the actuating means 30, thus defeating the operable feature of the present invention. For this reason, the preferred form of radial projection 26 is a plurality of short discreet projections completely surrounded by the thinned region 28, the radial projections 26 being equally spaced about the circumference of lid 20. The number of such projections 26 is not crucial. However, it is believed that at least three such discrete projections should be included with six or more such projections being preferable.

A second embodiment of the present invention is shown in FIGS. 4–7 wherein a closure 110 according to the present invention is applied to container 112, the container having a groove 114 on an inside surface 116 near the mouth 118 of container 112. The closure 110 includes a lid 120 having a central disk 122 and an upstanding wall 124 at the periphery of the central disk 122. A plurality of radial projections 126 are provided on the upstanding wall, each radial projection 126 being surrounded by a region 128 which is thinner than the remaining portions of the upstanding wall 124.

An actuating means 130 is provided radially inside the upstanding wall 124 for radially displacing the plurality of projections 126 outward for engagement with the radial groove 114 on the inside surface 116 of container 112. The actuating means 130 includes ring 131 having a plurality of apertures 133 passing radially through the ring. A like plurality of tabs 129 hinged to central disk 122 passes through the plurality of apertures 133. The angular orientation of the tabs 129 is determined by the axial position of ring 131 with respect to lid 120. Thus, as ring 131 is axially displaced in the direction of cap A, the tabs 129 move from a nearly vertical orientation as shown in FIG. 4 through the position shown in FIG. 5 to a nearly horizontal position in FIG. 6, at which point the outermost end 127 of tab 129 contacts the inner surface of upstanding wall 124 immediately opposite radial projection 126 and displaces the wall outward to cause engagement of projection 126 with ring 114.

Flange 132 at the top of upstanding wall 124 projects radially outward and overlaps lip 134 of mouth 118 of the container 112. A sealing means, such as ring 136, can be provided between flange 132 and lip 134 to seal the contents of container 112 with the closure 110 of the present invention in place.

It will be appreciated that, since the material forming tab 129 and thinned region 128 are the same, the dimensions of thickness for both region 128 and tab 129 must be selected such that the compressional forces acting on tab 129 as shown in FIG. 6 are clearly more than enough to overcome any resistance to displacement which might remain in the thinned portion 128 of upstanding wall 124. Gussets 121 can be provided on the underside of disk 122 to strengthen the resistance of tabs 129 to inward radial movement. Further, the thinned regions 128 can be made circumferentially continuous as shown in FIG. 7 to enhance the flexibility of projections 126 with respect to the remaining portion of wall 124. This feature can be employed with either embodiment of the present embodiment as can the feature shown in FIG. 3.

As shown in FIG. 4, the ring 131 is positioned such that tabs 129 are just beginning to project through apertures 133. It will be appreciated that an upward movement of ring 131 with respect to lid 120 would cause complete disengagement of tabs 129 from apertures 133, and in this manner the ring 131 could easily be separated from lid 120. To prevent this separation after initial assembly of the lid 120 and ring 131, the inside surface 125 of upstanding wall 124 can include a shoulder 123 which interacts with end 127 of tab 129 at an intermediate position shown in FIG. 5. In this manner, shoulder 123 and end 127 of tab 129 function as a means for preventing separation of the lid 120 and the actuating means 130. Preferably, the lid 120 and ring 131 would be assembled to the position illustrated in FIG. 5 prior to any assembly with container 112.

After assembly of ring 131 and lid 120, the closure 110 of the present invention would be assembled with a container 112 having an appropriately dimensioned groove 114 on an interior surface thereof and the ring 131 would then be downwardly displaced in the direction of cap A, thus causing a corresponding rotation of tabs 129 from the position shown in FIG. 5 to the position shown in FIG. 6, thus forcing projections 126 outward to engage groove 114. Further downward displacement of ring 113 with respect to lid 120 could be prevented by contact between a lower surface 137 of ring 131 and the bottom of upstanding wall 124 or contact between an upper surface of flange 132 and flange 150 on ring 131 or by a dimple 138 engaging the lower surface of the outermost end 127 of tab 129. While FIG. 6 illustrates all three events occurring simultaneously, it will be appreciated that only one or possibly two such events is necessary in order to prevent further downward displacement of ring 131 with respect to lid 120. Various other changes or modifications of the closure according to the present invention can be made without departing from the spirit or scope of the present invention.

What is claimed is:

1. A closure for a container comprising:

a lid having a central disk, an upstanding wall at the periphery of the disk for contacting an interior surface of a container, a plurality of radial projections on an outside surface of the outstanding wall, a like plurality of regions of the upstanding wall, one each surrounding each radial projection, the regions being substantially thinner than the remaining portions of the upstanding wall for imparting radial flexibility between the plurality of projections and the remaining portions of the upstanding wall, and actuating means disposed radially inside the upstanding wall and axially displaceable with respect to the upstanding wall for radially displacing said plurality of projections.

2. The closure of claim 1 wherein said actuating means comprises a ring radially disposed inside the upstanding wall of the lid and axially displaceable with respect to the lid.

3. The closure of claim 2 further comprising means for preventing separation of the lid and actuating means.

4. The closure of claim 1 wherein there are at least three of said plurality of radial projections.

5. The closure of claim 1 wherein said regions surrounding each radial projection are at most only one-half as thick as the remaining portions of the upstanding wall.

6. The closure of claim 1 wherein said regions surrounding each radial projection are circumferentially continuous.

7. The closure of claim 1 wherein said plurality of radial projections are each circumferentially discontinuous and discrete.

8. A two-element closure for a container having a radial groove on an inside surface of the mouth of the container, the closure comprising:

a lid having a central disk, an upstanding wall at the periphery of the disk for contacting the inside surface of the mouth of the container, a plurality of circumferentially discrete radial projections on an outside surface of the upstanding wall, a region of the upstanding wall surrounding each radial projection which is substantially thinner than the remaining portions of the upstanding wall for imparting radial flexibility between the plurality of projections and the remaining portions of the upstanding wall, and actuating means disposed radially inside the upstanding wall and axially displaceable with respect thereto for radially displacing said plurality of projections for engagement with the radial groove on the inside surface of the mouth of the container upon the axial displacement of said actuating means.

9. The closure of claim 8 wherein said actuating means comprises a ring radially disposed inside the upstanding wall of the lid and axially displaceable with respect to the lid.

10. The closure of claim 8 wherein said region of the upstanding wall surrounding each radial projection is circumferentially continuous.

* * * * *